United States Patent [19]

Smith

[11] 4,141,510

[45] Feb. 27, 1979

[54] MATERIAL REDUCTION MEANS FOR PUMPS

[76] Inventor: Arthur Smith, 1845 Randolph St., Los Angeles, Calif. 90001

[21] Appl. No.: 806,724

[22] Filed: Jun. 15, 1977

[51] Int. Cl.[2] ..... B02C 23/36

[52] U.S. Cl. ..... 241/46 A; 241/46.02; 241/46.17; 241/185 A

[58] Field of Search ..... 241/46 R, 46 A, 46 B, 241/46.02, 46.08, 46.11, 46.17, 152, 152 A, 161, 162, 163, 185 A, 246, 247

[56] References Cited

U.S. PATENT DOCUMENTS

| | | | |
|---|---|---|---|
| 2,029,766 | 2/1936 | Durdin, Jr. | 241/46 A |
| 2,200,061 | 5/1940 | Green | 241/46 A |
| 3,128,051 | 4/1964 | Smith | 241/46.11 |
| 3,650,481 | 3/1972 | Conery et al. | 241/46.11 |
| 3,726,486 | 4/1973 | Smith et al. | 241/46.11 |
| 3,734,148 | 5/1973 | McCulty | 241/247 |

*Primary Examiner*—Joseph H. McGlynn
*Attorney, Agent, or Firm*—Georges A. Maxwell

[57] ABSTRACT

A pump adapted to ingest, reduce and deliver combined fluid and solid materials. The pump includes a centrifugal pumping means with a volute chamber, central inlet opening, a substantially tangential outlet opening and a vaned rotor within the chamber; a milling means at and about said inlet opening and including an elongate milling ring with upstream and downstream ends and elongate circumferentially spaced grooves and teeth about its inner peripheral portion and a milling disc rotatable within the ring and drivingly coupled with said rotor, said disc carrying circumferentially spaced shearing blades overlying the downstream end of the ring and shearing blocks with circumferentially and radially disposed material engaging surfaces within the confines of the ring; and material feed means to reduce and deliver material to the milling means and including a material conducting bore upstream of the milling ring, a lateral material supply duct communicating with the bore and an elongate helical screw in the bore and drivingly coupled with the disc and a prime mover drivingly coupled with one end of that rotary assembly made up of said rotor, disc and screw.

6 Claims, 6 Drawing Figures

MATERIAL REDUCTION MEANS FOR PUMPS

This invention has to do with an improved waste reducing and pumping means and is more particularly concerned with a fluid pump induction means having solid waste milling and reducing capabilities.

Throughout the various arts where fluids and large particles and/or pieces of solid matter are likely to be combined and where the moving and disposal of the combined fluids and solids is required, it has long been common practice to provide means to separate the solids from the fluids for independent disposal of each. The above practice has been followed due to the fact that strict limits are placed on the size of solid matter that can be discharged into fluid waste disposal systems such as sewers and due to the fact that conventional pumping means provided to effectively move fluids cannot effectively or efficiently move large pieces of solid matter and tend to become jammed and/or plugged thereby.

In recent years, several special pumps provided with grinder means at their inlets have been provided by the prior art. The grinder means in such pumps serve to grind up or to reduce solid matter carried by the fluids drawn into the pumps. The grinder means are intended to reduce the size of the solids encountered to a size which will not adversely affect the operation of the pumps and to a size which is below the largest permissible size of solid matter than can be discharged into the waste systems to which the discharge of the pumps is directed.

One of the above noted pumps with grinder means is disclosed in my U.S. Pat. No. 3,128,051 issued Apr. 7, 1964, and entitled PUMP. Another such pump is disclosed in U.S. Pat. No. 3,650,481 entitled GRINDER PUMP and issued to William J. Conery, et al on Mar. 21, 1972.

The structures of the above noted prior art Pump and Grinder Pump comprise centrifugal pumps with annular, grooved, milling rings arranged at the inlet passages or openings of the pumps and milling discs with material engaging protruberances rotatably arranged within the rings and drivingly coupled with the rotors of the pumps. While the above structures are effective to mill and reduce some solids carried by the fluids drawn into the pumps, they are often slow to reduce the solids and are readily plugged and jammed by commonly encountered fibrous materials such as rags, bandages, sanitary napkins, pantyhose and the like. Further, the size of solid matter which these prior pump structures can effectively handle or ingest is quite limited.

It has been found that most soft long fibre materials such as fabrics or rags and many vegetable fibres tend to collect on and about the milling discs and are not effectively caused to move and advance between the discs and their related milling rings. Such materials often accumulate and build up sufficiently to impede the flow of the fluid carrier into the pumps to such an extent that the pumps lose prime and the structure are rendered inoperative.

It has also been found that large objects such as sticks frequently become bridged across the inlet end of the milling means of such prior art pumps and establish structure on which other foreign solid materials become lodged to plug and foul the pump structure.

In the above noted prior art pumps, the time it takes for the milling means to reduce hard solid particles to a size which will permit them to pass between the milling discs and rings is often extensive and such that it is not infrequent that hard materials will accumulate faster than they can be reduced. When this takes place the pump structures become fouled and fail to function as intended. The slow milling and/or reducing action is a result of the fact that hard to reduce materials tend to be kicked or knocked about substantially freely within the milling rings by the discs and/or the material moving protruberances thereon. But for the flow of fluid drawn through the milling means by the pumps, there is no material feed means for advancing the solids into the milling means.

It is not infrequent that the pumps of the prior art noted above must be let to run or operate for exceedingly long periods of time to effect reduction and disposal of a rather small quantity of solid matter. Such is not only inefficient with respect to time but it is inefficient with respect to power consumption and oftentimes with respect to the volume of fluid that must be used to effect flushing and/or carrying of the reduced materials away.

The milling rings provided in the noted prior art pumps are of substantial axial extent and are provided with a multiplicity of circumferentially spaced radially inwardly opening and axially extending fluid and solid material conducting grooves, which grooves define intermediate radially inwardly projecting, axially extending milling ribs with radially inwardly disposed inner faces and sharp corner edges. The milling discs are of less axial extent than the rings, have cylindrical outer edges and are rotatably supported in the rings with running clearance and adjacent the downstream ends of the rings. The discs are next provided with a plurality of fixed, circumferentially spaced, axially projecting protruberances at their upstream ends or surfaces. The protruberances have substantially circumferentially disposed surfaces and edges that oppose the ring with running clearance. When the discs rotate, the protruberances strike and move pieces of solid material within the ring in and about the ring to effect milling or reduction of such matter. As the protruberances move circumferentially and by the milling ribs on the rings, they shear any solid material advanced into and which projects radially inwardly from the grooves.

In practice, it is not infrequent that matter within the cutting rings in the prior art pumps and engaged by the protruberances is such that the protruberances fail to shear it and the milling means are jammed, that is, the milling discs are stopped. Such can happen when hard or tough solid matter is encountered, such as pices of bone, metal and certain plastic materials. Such jamming also occurs when tough long fibre solid materials such as fabric, jute and straw are encountered.

In addition to the above, the milling means of the noted prior art pumps are provided with a plurality of circumferentially spaced shearing blades directly or indirectly related to the milling discs. The shearing blades project radially outwardly from the discs to occur adjacent the downstream ends of the milling rings to move by the downstream ends of the grooves and ribs of the rings and to cut and/or shear solid material moving downstream and out through the grooves. In the case of the above noted Smith patent, the shearing blades are defined by the veins of the centrifugal pump, while in the noted Conery, et al. patents, the shearing blades are defined by the ends of fluid moving veins of an axial flow inducer means interposed between the milling disc and the pump rotor.

An object and feature of my invention is to provide an improved pump with improved material milling means at the inlet of the pump and with material feed means upstream of said milling means.

It is an object and feature of my invention to provide a pump of the character referred to which is such that solid materials upstream of the milling means is forcibly moved downstream into and through the milling means whereby such matter is not subject to collecting and building up in the milling means so as to plug and foul the construction.

Yet another object and feature of this invention is to provide a pump of the character referred to which is such that the material feed means cuts and reduces the size of solid matter advanced to the milling means to a size which will not effectively bridge across the upstream end of the milling means and to a size which is such that the milling means can effectively, rapidly and efficiently reduce such material for free and effective movement into and through the related pump.

Still another object and feature of my invention is to provide a milling means including milling blocks on the milling disc to oppose the milling ring, which blocks are shiftable radially inwardly whereby they are free to move inwardly and ride over hard solid pieces of material which engage between the milling ring and the blocks and which are not immediately sheared thereby, whereby such pieces of material will not jam and foul the construction.

It is another object and feature of the present invention to provide a pump of the character referred to above wherein the milling means includes shearing blades and the disc, which blades project radially outwardly adjacent the downstream end of the ribs and grooves of the milling ring to shear matter moving downstream through and from the grooves in the ring.

An object of my invention is to provide a pump of the character referred to wherein the material feed means includes an elongate helical screw with a cutting edge drivingly coupled with and extending upstream from the milling disc and pitched to advance material downstream, a fluid conducting body or chest about the screw and having axially spaced radially inwardly projecting helically curved shearing ribs arranged and disposed to cooperate with the cutting edge of the screw to cut and shear large pieces of material which exceed a size that can be effectively worked upon by the milling means.

It is an object and feature of my invention to provide a pump of the character referred to wherein the pump with which the milling and feed means are related is a centrifugal pump having a rotor drivingly coupled with the milling disc with which said screw is drivingly coupled and a pump structure wherein a single prime mover is coupled with an end of the assembled rotor, disc and screw.

The foregoing and other objects and features of my invention will be understood from the following detailed description of typical preferred forms and applications of my invention throughout which description reference is made to the accompanying drawings in which.

Figure 1:
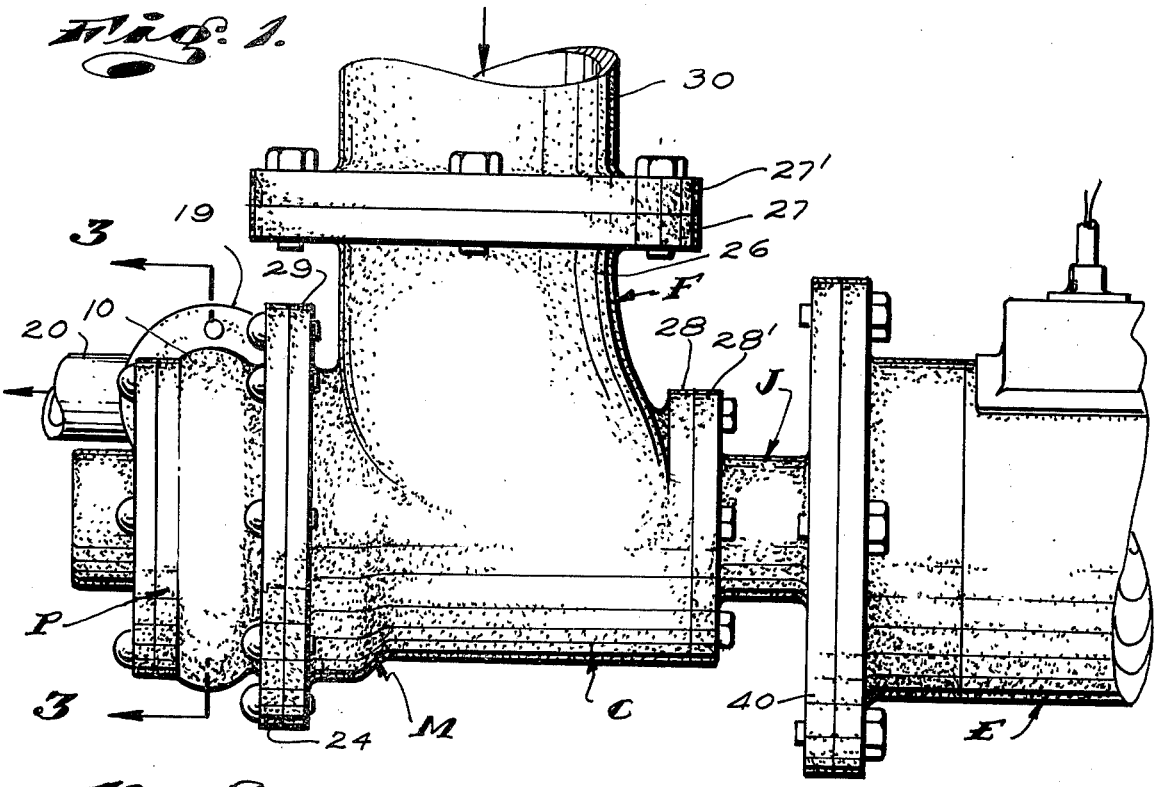
FIG. 1 is a side elevational view of my new pump.
Figure 2:
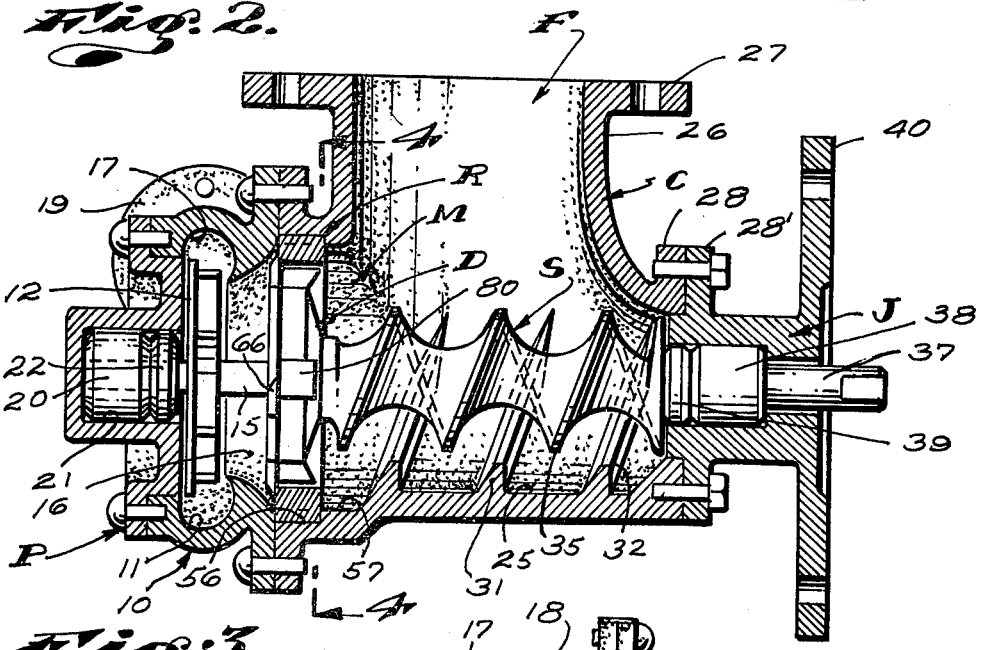
FIG. 2 is a longitudinal sectional view of the pump.
Figure 3:
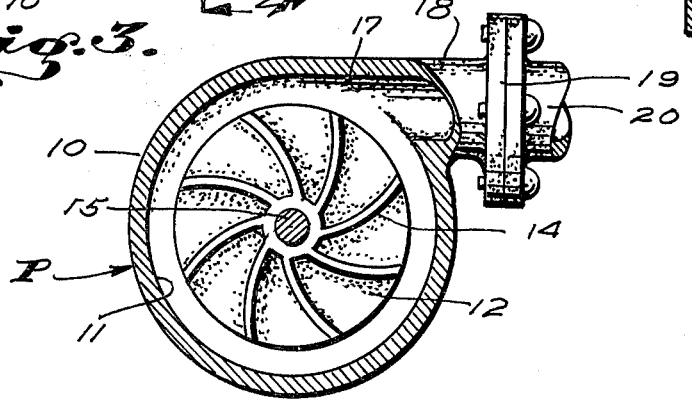
FIG. 3 is a cross-sectional view taken substantially as indicated by line 3—3 on FIG. 1.

Referring to the drawings, the pump that I provide includes fluid pumping means P, milling means M, feed means F and a prime mover E.

The means P, M and F are elongate means with upstream and downstream or front and rear ends and are arranged on a common central axis, in end to end relationship.

The pumping means P is a substantially conventional centrifugal pump structure having a stationary external case 10, defining a radially extending volute chamber 11, a radially extending rotor 2 with vein 14 and an elongate central, axially extending shaft 15 rotatably supporting the rotor within the chamber.

The pump means is at the downstream end of the construction and its case 10 is provided with a central large diameter inlet opening 16 at its front or upstream end. The case 10 next includes a discharge passage 17 extending tangentially from the chamber and through a laterally projecting discharge neck 18. The neck 18 is provided with a coupling flange 19 to facilitate connecting the pumping means with a waste pipe 20, or the like, substantially as shown.

The shaft 15 is rotatably supported by a bearing 20 in a recess 21 provided in the downstream end or wall of the case. A suitable seal 22 is provided in the recess 21 and about the shaft 15, forward of the bearing 20. The shaft 15 has a front or upstream end portion which projects freely through and from the inlet opening 16 to connect with the means M, as will hereinafter be described.

Finally, the case 10 of the pump means P has a mounting flange 24 at its front or upstream end about the opening 16 to facilitate connecting the case 10 with a body or chest C.

The milling means M that I provide is arranged within the chest C and includes an annular milling ring R adjacent to and concentric with the inlet opening 16 of the pump means P and a rotatable milling disc D within the ring and drivingly coupled with the shaft 15.

The details of construction of the means M will be considered following description of the feed means F. The feed means F that I provide includes the above noted elongate chest C. The chest C has front and rear or upstream and downstream ends. The chest C defines a central longitudinal bore 25 and is provided with lateral tubular inlet neck or duct 26 communicating with the bore 25 intermediate the ends thereof. The duct 26 and the upstream and downstream ends of the body are provided with mounting flanges 27, 28 and 29, respectively.

The flange 29 is engaged with the flange 24 of the pump case 10 and is secured therewith by suitable screw fastening means, substantially as shown. The bore 25 of the body B is concentric with the axis of the pump means and is arranged with its downstream or rear end in communication with the inlet opening 16 of the pump means. The flange 27 on the inlet duct 20 is engaged with a complimentary flange 27′ on a fluid supply duct 30 which serves to conduct liquids and solids to be worked upon into the feed means F.

The flange 28 at the rear or upstream end of the body B is engaged with a complimentary flange 28′ on a journal plate J related to and closing the front or upstream end of the bore 25.

The chest C is not unlike a T-fitting and is such that the upper portion of the bore 25 is interrupted by the duct 26 which communicates therewith. The lower portion of the bore 25 is provided with a plurality of axially spaced radially inwardly projecting and axially helically pitched cutting ribs 31 with flat radially extending axially disposed flanks and flat radially inwardly disposed axially extending lands which converge with said flanks to define sharp cutting edges 32.

The feed means F next includes an elongate screw S arranged concentrically within the bore 25. The helical thread of the screw has a straight cylindrical radially outwardly disposed land and axially inclined or curved flanks establishing valleys of substantial radial extent or depth. The diameter of the screw is such that the lands or ridges 35 of the thread are spaced radially from the bore 25 and occur in close shearing proximity to the lands or cutting edges 32 on the ribs 31. The downstream or rear end of the screw S is provided with a threaded axle pin 36 to engage the disc D of the means M, as clearly shown in the drawings and as will hereinafter be described.

The upstream or front end of the screw S is provided with an axle pin 37 which pin projects freely through the aforementioned journal plate J secured to the front end of the body and which closes the front or upstream end of the bore 25. The plate J carries a bearing 38 and a seal 39 to rotatably support and seal about the pin 37.

While the screw S is similar to an Archimedes screw, within the bore 25, its primary function is to first shear, shred or reduce solid material introduced into the bore 25 through the inlet duct 26 and to thereafter advance that material downstream or axially rearwardly into working relationship within the means M.

The inlet duct 26 is a large diameter duct and communicates with one side of the bore 25 to substantially eliminate or open that side of the bore whereby the bore is only about 180° in circumferential extent throughout its major longitudinal extent and is open, laterally, so as to freely receive large objects or pieces of solid material.

The axially spaced ribs 31 are also little more than 180° in circumferential extent and occur about the lower portion of the bore or about that side of the bore which is opposite the duct 26.

With the above relationship of parts, solid material moving laterally into the bore 25 of the chest from the duct 26 is free to move between the ribs 31 and into the valleys of the screw. When such material becomes engaged in and between the flanks of the screw and the ribs and as the screw is rotated, the material is effectively sheared and/or reduced and is also advanced downstream toward the milling means M. The lateral feeding of material into the means F is highly effective and desirable since long pieces of solid material such as sticks of wood and the like, which could not otherwise enter between the bore and the screw can be advanced therebetween, a portion at a time, and can be effectively reduced thereby.

The journal plate J at the front or upstream end of the body B is provided with a mounting flange 40 on which the prime mover E is mounted. The prime mover E is preferably an electric motor of suitable design and size and is drivingly coupled with the pin or shaft 37 of the screw S by conventional drive coupling means (not shown).

Referring once again to the milling means M, the milling ring R is an elongate angular ring, rectangular in cross-section. The ring has an exterior cylindrical surface 50, flat radially extending front and rear ends 51 and 52 and a cylindrical inside surface 53. The radial outer portion of the ring is plain or uninterrupted while the radial inner portion of the ring is provided with a plurality of circumferentially spaced axially extending and radially inwardly opening fluid conducting grooves 54. The grooves 54 in the ring define a plurality of circumferentially spaced radially inwardly projecting, axially extending shearing teeth 55. The surface 53 of the ring defines longitudinally straight radially inwardly disposed lands on the teeth 55 while the grooves 54 cooperate to define the opposing flanks of adjacent teeth. The flanks and lands of the teeth converge to establish sharp longitudinally extending cutting edges on the teeth.

The radial outer portion of the ring R is seated in a radially inwardly axially rearwardly opening annular seat 56 formed in the rear or downstream end of the chest C of the means F. The seat 56 is established in a counter bore 57 at the downstream end of the bore 25. The counter bore 57 is larger than the bore 25 and defines a milling chamber into which the grooved and toothed radial inner portion of the ring projects.

Figure 4:
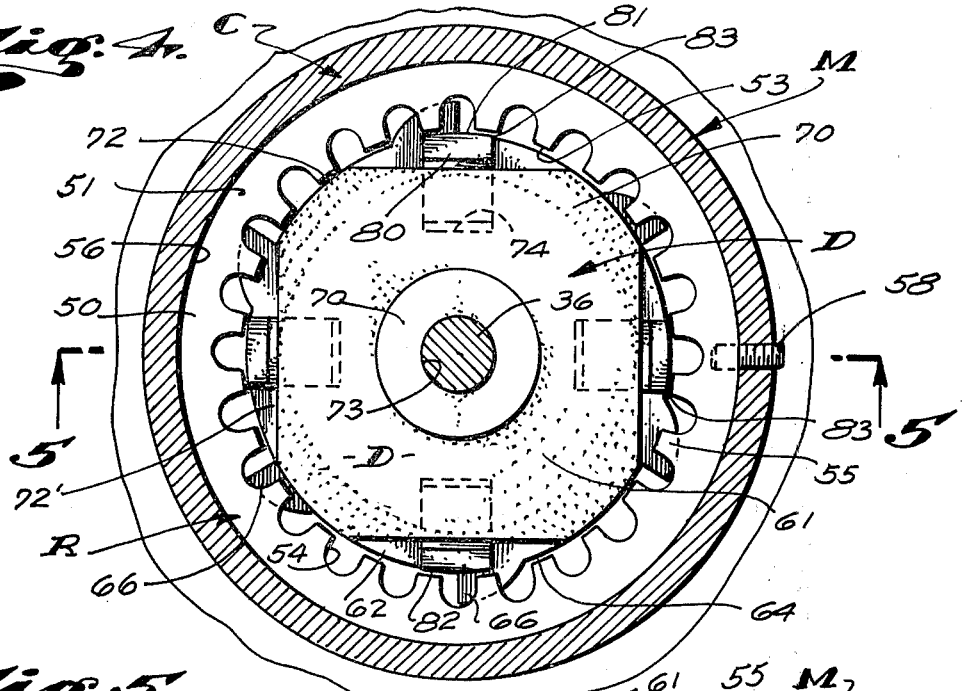
FIG. 4 is a cross-sectional view taken substantially as indicated by line 4—4 on FIG. 2.
Figure 5:
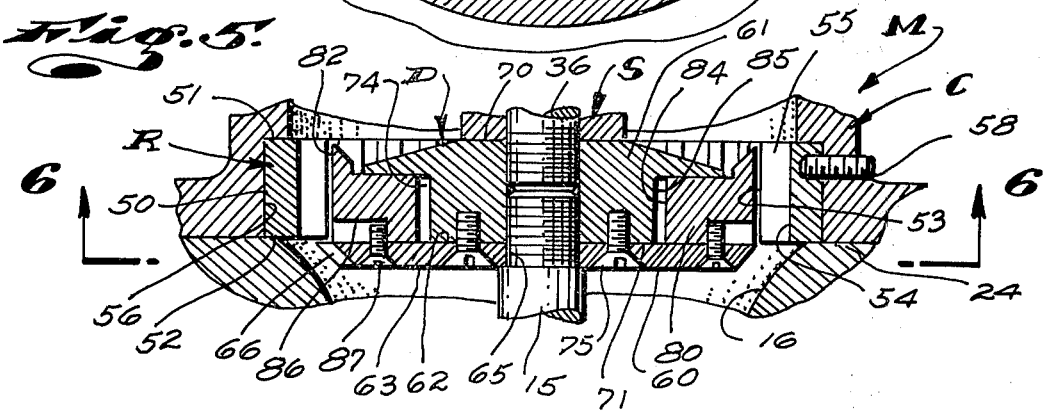
FIG. 5 is a sectional view taken substantially as indicated by line 5—5 on FIG. 4.
Figure 6:
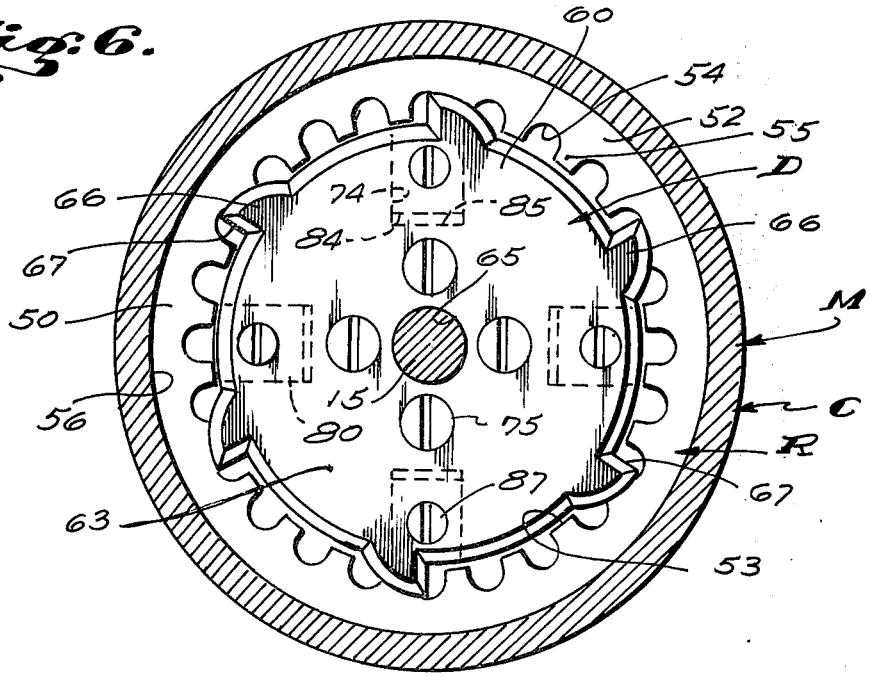
FIG. 6 is a sectional view taken substantially as indicated by line 6—6 on FIG. 5.

In practice, as shown in FIGS. 4 and 5 of the drawings, a set screw 58 is provided to lock or set the ring R against rotation in the seat. The set screw 58 is engaged through the chest from the exterior of and projects radially inwardly into a cavity or opening provided in the exterior of the ring.

The ring R is retained in the seat 56 by the flange 24 of the pump case 10. The radial inner portion of the flange 24, adjacent to and defining the pump inlet 16, overlies the outer radial portion of the rear surface 52 of the ring, radially outward of the teeth 55 and grooves 54 of the ring.

The milling disc D includes a substantially flat radially disposed assembly comprising a flat downstream or rear plate 60 and a front or upstream body 61.

The plate 60 is a flat steel plate with front and rear surfaces 62 and 63, an outer edge 64 and a central opening 65. Additionally, the plate 60 is provided with a plurality (4) of circumferentially spaced radially outwardly projecting shearing blades 66 with radially extending cutting edges disposed circumferentially in the direction of rotation of the disc. The diameter of the plate is slightly less than the inside diameter of the ring R and the cutting blades 66 are substantially equal in radial extent with the radial extent of the teeth 55 and grooves 54 of the ring R.

The plate 60 is arranged or positioned axially of the construction so that its front surface 62 is in substantially but slightly downstream or rearward of the rear surface 52 of the ring R whereby the blades 66 move circumferentially by the teeth and by the grooves of the ring when the disc rotates.

In practice, a close running clearance is provided between the cutting blades and the ring so as to avoid or prevent adverse wearing of the ring and/or blades.

The body 61 of the disc D is a cast or forged steel part with front and rear surfaces 70 and 71, a substantially cylindrical side surface 72 and a central threaded opening 73. In addition, the body is provided with a plurality (4) of circumferentially spaced radially outwardly and axially rearwardly opening recesses 74. In the preferred carrying out of the invention, the exterior of the body is provided with a plurality (4) of radially outwardly disposed flats 72' at which the recesses 74 enter.

The body 61 is arranged within the ring R, with running clearance and with its rear surface 70 in flat bearing engagement with the front surface 62 of the plate 60, whereby the rear sides of the recesses 74 are closed by said plate.

The plate and body are secured together in tight relationship and against relative rotation by screw fastening means 75.

The forward end of the pump shaft 15 is threadedly engaged through the opening 65 in the plate and into the openings 73 in the body from the rear end thereof whereby the disc is drivingly coupled with the pump. The axle pin 36 on the rear end of the screw S of the feed means F is engaged in the opening 73 in the body from the front end thereof, whereby the disc D and the screw S are drivingly coupled together.

In addition to the foregoing, the disc D of the means M includes a plurality (4) of elongate radially extending shearing blocks 80 slidably engaged in the recesses 74.

The recesses 74 are preferably substantially square in cross-section and the radial inner end portions of the blocks 80 are substantially square in cross-section and are slidable into and out of engagement in the recesses.

The radial outer end portions of the shearing blocks 80 project outwardly from the recesses and from the body at the flats 72' and have radially outwardly disposed outer ends 82 which normally oppose the inside surface 53 of the ring R in close running clearance.

The end surfaces 81 of the blocks cooperate with the flat sides of the blocks to define sharp axially extending cutting edges 83 which are parallel and oppose sharp cutting edges defined by the teeth 55 of the ring R.

The longitudinal extent of the blocks 80 is such that when the blocks are in their normal position, at least two-thirds of the blocks occur within and are supported and guided in their related recesses. Further, the blocks are of such longitudinal extent that when they are in their normal position, the radial inner ends 84 of the blocks are spaced from opposing inner ends 85 in the notches, a substantial distance whereby the blocks are free to shift radially inwardly from their said normal position.

In practice, and as shown in the drawings, the radial outer end portions of the blocks are formed so that the axial extent of their outer ends is substantially equal to the axial extent of the ring R whereby the blocks cooperate with the teeth of the ring throughout the entire longitudinal extent of said teeth.

Finally, the means M that I provide includes stop means to limit radial outward shifting of the blocks 80 relative to the disc and to normally retain the blocks in their normal working position relative to the ring R. The stop means can vary widely in practice and is shown as including an elongate radially extending axially inwardly opening slot 86 in each block and stops 87 carried by the plate 60 and projecting axially forwardly therefrom and into the slots 86, The stops 87 are shown as simple screw fasteners engaged through and carried by the plate 60.

While the annulus between the disc D and ring R, established by the working clearance provided, affords for the flow of some fluid downstream through the means M, the grooves 54 in the ring provide for the principal flow of fluids and solids through said means. The cumulative cross-section of the noted annulus and the grooves 54 is substantial and is adequate with respect to the flow capacity of the pump means P that is provided.

It is important to note that the flats 72' about the perimeter of the disc D cooperate with the ring R to define axially forwardly opening segmental recesses of substantial radial extent into which rather large objects or pieces of solid material is free to enter and into or which the blocks freely project.

In operation, when a piece of solid material enters between the disc D and the ring R and is engaged between a shearing block carried by the rotating disc and a tooth on the fixed or stationary ring, it is, under ordinary circumstances, sheared and reduced to a size which will freely move axially downstream through the grooves and into the pump means. Should such a piece of material stopped on a tooth be sufficiently tough and hard so that it is not immediately sheared by the block which first engages it, that block is free to shift radially inwardly and to ride over or move by that piece of material, whereupon the next advancing block will strike and shear or reduce it in size.

In practice, it has been found that if a piece of material stopped against a tooth is not sheared by the block which first engages it, the second block most frequently will shear it. If the second block to engage the hard material fails to shear it, the third or fourth block to engage it will shear or otherwise reduce it.

Of equal and possibly greater importance than the ultimate shearing and reduction of hard objects or pieces of solid material in the manner set forth above is the ability of the shearing blocks to ride over such objects in such a manner that the construction is not jammed and stopped by such objects.

As a result of the ability of the blocks to ride over hard objects and to repeatedly work on such objects to reduce them, the construction need not be constantly monitored by an attendant for the purposes of turning the power off before the prime mover is burned out and for the purpose of dismantling and cleaning or freeing the construction of such objects.

It is to be noted and it will be apparent that the blocks are normally urged and held out in their normal position by centrifugal force. Accordingly, the need for spring means or the like to normally yeildingly hold the blocks in their normal position is not ordinarily required.

The cutting blades 66 on the plate 60 of the disc D are such that when they move by the teeth 55 of the ring R and engage solid material advancing downstream and out of the grooves 54 of the ring, they cooperate with the teeth to effectively shear and reduce that material. The cutting blades, working as noted above, are particularly suited and effective to cut and shear long pieces of fibrous material which tend to move longitudinally downstream through the grooves, free of the shearing blocks and which would tend to collect on and about the pump rotor and to plug and foul the pump means.

In operation of the construction, a mixture of fluid and solid material is conducted to the inlet duct of the chest C and is directed into the bore 25 where it is enaged and worked upon by the screw S. The screw S cooperates with the ribs 31 in the bore to cut and reduce large pieces of solid material and advances all solid materials and fluid downstream into the milling means M. The milling means M mills and further reduces the size of the solid material delivered to it by the feed means F. Still further, as the solid materials are advanced out of the means M into the pump means P, they are again worked upon by and between the ring teeth and cutting blades of the disc D to still further reduce the material and render it freely pumpable and incapable of plugging and/or fouling the pump means.

The prime mover E, as noted above, is preferably a simply electric motor structure mounted on the flange 40 of the journal plate J and is drivingly coupled with the axle pin or shaft 37 of the screw S.

It is to be noted and understood that the details of construction illustrated in the drawings and described in the foregoing is but one embodiment of my invention and that in practice, many of the details of construction can be varied widely without in any way departing from the spirit of my invention.

Having described only one typical preferred form and carrying out of my invention, I do not wish to be limited to the specific details herein set forth, but wish to reserve to myself any modifications and/or variations that may appear to those skilled in the art and which fall within the scope of the following claims:

Having described my invention, I claim:

1. A pump including an elongate housing structure with front and rear ends defining a radially extending volute chamber within its front end portion, a central inlet opening communicating with the front end of the chamber and an outlet passage substantially tangential with and communicating with the chamber, a rotor with substantially radially extending vanes positioned in the chamber and support means carried by the housing structure and rotatably supporting the rotor; a milling chamber defined by the housing structure forward of the volute chamber and adjacent said inlet opening; an elongate milling ring with circumferentially spaced radially inwardly and axially opening material conducting grooves defining elongate axially extending circumferentially spaced milling teeth; an elongate milling disc positioned within the rings, coupling means drivingly coupling the disc with the rotor, said disc carrying a plurality of circumferentially spaced milling blocks with radially extending circumferentially disposed material engaging side surfaces and radially outwardly disposed ends opposing said grooves and teeth; said housing structure defining an elongate bore concentric with and extending forwardly from the milling chamber and a material receiving duct communicating with the bore to conduct material into the bore; an elongate screw with front and rear ends positioned within the bore, coupling means drivingly coupling the rear end of the screw with the disc and support means carried by the front end of the housing structure and rotatably supporting the front end of the screw, said screw having a helical thread pitched to advance material in the bore rearwardly toward the milling chamber when the assembly comprising the rotor, disc and screw is rotated; said assembly having a driving shaft extending axially from its related end of the housing structure; and, a prime mover with an output shaft drivingly coupled with said driving shaft; said shearing blocks are shiftably radially inwardly from a normal out to in position relative to the disc and the rings whereby said blocks will shift radially inwardly and ride over hard materials engaged between the blocks and the rings and which are not reduced thereby.

2. The pump set forth in claim 1 which further includes circumferentially spaced shearing blades projecting radially outwardly from said disc and overlying the rear end of said ring.

3. The pump set forth in claim 1 which further includes helically pitch shearing ribs in the bore and projecting radially inwardly into material shearing relationship with the screw thread.

4. The pump set forth in claim 3 which further includes helically pitch shearing ribs in the bore and projecting radially inwardly into material shearing relationship with the screw thread, and circumferentially spaced shearing blades projecting radially from said disc and overlying the rear end of the ring.

5. The pump set forth in claim 4 wherein said duct communicates with a side of said bore between the ends thereof.

6. The pump set forth in claim 5 wherein said disc has circumferentially spaced, elongate, radially extending and radially outwardly disposed recesses, said milling blocks are elongate parts with radially extending inner end portions slidably engaged in said recesses; and stop means between the disc and the blocks to limit radial outward shifting of the blocks relative to the disc and to allow for substantially free radial inward shifting of said blocks from a normal out position to an actuated in position.

* * * * *